United States Patent [19]

Leong

[11] Patent Number: 4,760,802

[45] Date of Patent: Aug. 2, 1988

[54] TABLE AND STOOL ASSEMBLY

[75] Inventor: Po S. Leong, Canoga Park, Calif.

[73] Assignee: Walter Fleisher Company, Van Nuys, Calif.

[21] Appl. No.: 88,597

[22] Filed: Aug. 24, 1987

[51] Int. Cl.[4] ..... A47B 13/02

[52] U.S. Cl. ..... 108/157; 108/150; 248/188.1; 403/344

[58] Field of Search ..... 108/150, 51.3, 157, 108/901, 56.1; 248/188.1, 158, 916; 52/578; 403/344

[56] References Cited

U.S. PATENT DOCUMENTS

| | | | |
|---|---|---|---|
| 593,646 | 11/1897 | Donovan | 403/344 X |
| 2,488,309 | 11/1949 | Mason | 403/344 X |
| 2,742,116 | 4/1956 | Fitzgerald | 108/157 X |
| 3,664,275 | 5/1972 | Kleinart | 108/150 |
| 3,747,268 | 7/1973 | Linder | 403/344 X |
| 3,756,169 | 9/1973 | Dybvig | 108/150 |
| 4,078,757 | 3/1978 | Waters | 108/150 X |
| 4,208,072 | 6/1980 | Iskendarian | 108/150 X |

FOREIGN PATENT DOCUMENTS

| | | | |
|---|---|---|---|
| 987918 | 3/1965 | United Kingdom | 108/150 |

*Primary Examiner*—Peter A. Aschenbrenner
*Attorney, Agent, or Firm*—Keith D. Beecher

[57] ABSTRACT

A table and stool set in which identical tubular columns are used for the table and for the stool. The columns are formed of a resilient plastic. A rigid table top is provided with a circular groove in its lower surface which receives the upper lip of the tubular column. A base for the table is provided with a circular groove in its upper surface for receiving the lower lip of the table column. Two grooved lids are provided for receiving the upper and lower lips of the stool column to form a stool.

6 Claims, 1 Drawing Sheet

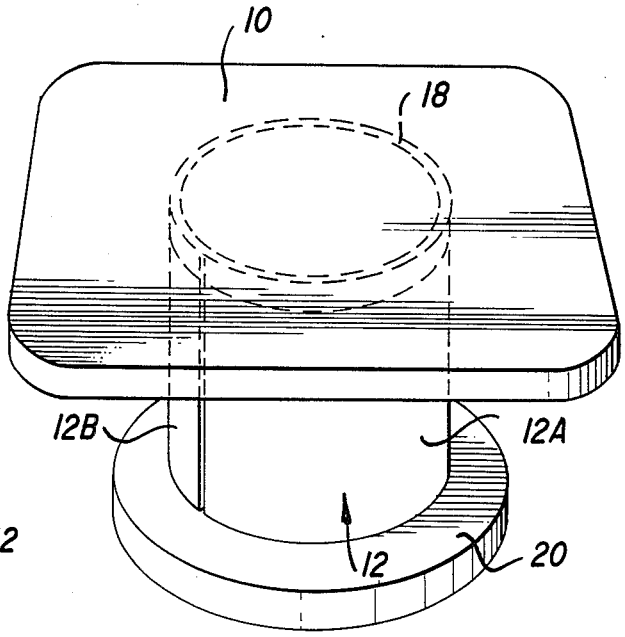
FIG. 1
FIG. 3
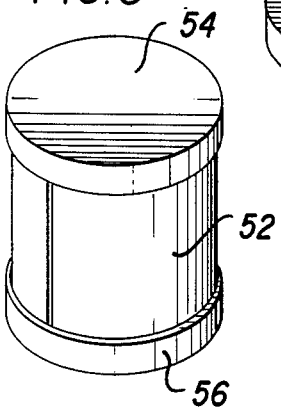
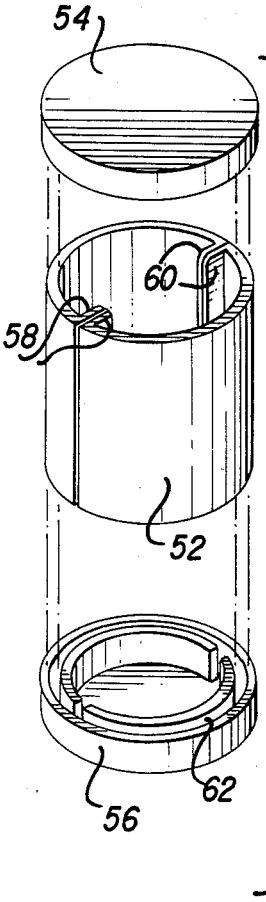
FIG. 4
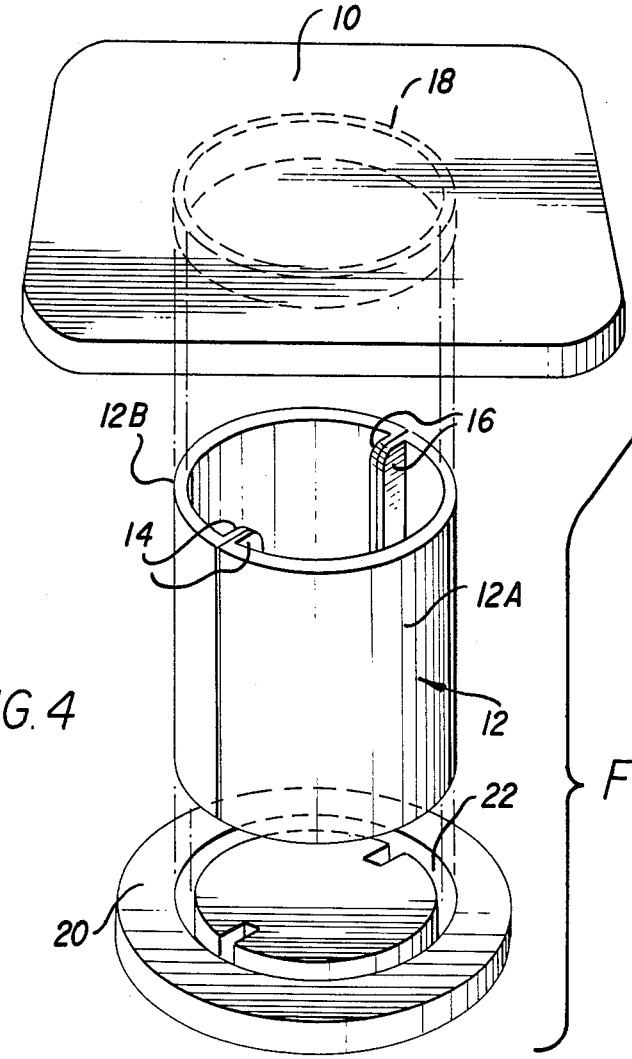
FIG. 2

TABLE AND STOOL ASSEMBLY

BACKGROUND OF THE INVENTION

A simple, compact and inexpensive table and stool set for eating, playing, studying and the like.

The components of the table and stool may be easily assembled and disassembled without the need for any tools, or the like.

The components of the table and stool set, when unassembled, fit flat into a compact container for ease of shipment. When assembled, the components provide a sturdy, strong, rigid and stable table and stool.

BRIEF DESCRIPTION OF THE DRAWING

FIG. 1 is a perspective view of the table of the present invention in one of its embodiments;

FIG. 2 is a disassembled perspective view of the table of FIG. 1;

FIG. 3 is a perspective view of a stool constructed in accordance with the concepts of the invention; and FIG. 4 is a perspective disassembled view of the table of FIG. 3.

DETAILED DESCRIPTION OF THE ILLUSTRATED EMBODIMENT

In the illustrated embodiment, the table includes a column 12 formed, for example, of an appropriate resilient plastic material such as polystyrene.

The column 12 is in the form of a right cylinder, and it is made up of two arcuate diametrically opposite components 12A and 12B formed from the sheet 12. Radially inwardly extending flanges 14 and 16 are formed on the adjacent edges of the arcuate sections 12A and 12B.

The upper lip of the column 12 is received in a groove 18 formed on the underside of a rigid table top 10. The table top is formed, for example, of a rigid plastic material having the groove 18 molded into its lower surface.

A base 20 for the table is provided which, likewise, may be formed of a rigid plastic material. The base has a roove 22 molded in its upper surface. Groove 22 receives the lower lip of the column 12.

The grooves 18 and 22 are deep enough so that the column 12 is firmly held in place in the grooves, so that the resulting structure is sturdy, strong and stable. However, the components of the table may be disassembled from one another merely by pulling the top 10 and base 14 away from the column 12.

An identical column 52, provided with flanges 58, 60 (FIG. 4) is used to form a stool, such as shown in FIG. 3. The stool includes lids 54 and 56 of appropriate rigid plastic material, each having a groove therein, such as groove 62, for receiving the upper and lower lips of the column 52.

The invention provides, therefore, an improved table and stool set in which each are held together by a single column. The column is originally composed of a flat sheet of resilient or flexible material which is held in place by means of the grooves in the table top and base, and in the lids of the stool. In this manner, the flat sheets forming the column are held to form a round right cylindrical strong structure. The flanges at the edges of the sheets forming the column give strength to the flat sheet when it is bent to its arcuate shape.

The flat sheets making up the columns as held in the deep grooves of the table top and base, and of the stool lids, in a secure manner because the lid material, as well as the table top and table base material, may be flexible enough to provide good frictional adhesion against the column. However, as mentioned above, the columns can also be easily removed by anyone who wishes to dismantle the table or stool. The stool lids at each end of the column may be identical to one another so that the stool may be used with either end up.

As mentioned above, all of the components of the table and stool may be conveniently shipped flat in a convenient container to facilitate shipment.

It will be appreciated that while a particular embodiment of the invention has been shown and described, modifications may be made. It is intended in the claims to cover all modifications which come within the true spirit and scope of the invention.

I claim:

1. A table comprising: a right cylindrical column formed of two sheets of resilient material positioned diametrically opposite to one another, with the sheets having radially inwardly extending flanges formed at the adjacent edges thereof; a rigid table top having a circular groove in the underside thereof for receiving the upper lip of the column; and a rigid base having a circular groove in the top side thereof for receiving the lower lip of the column.

2. The table defined in claim 1, in which the column is formed of a plastic material.

3. The table defined in claim 1, in which the top and base are formed of a molded plastic material.

4. The table defined in claim 1, and which includes a stool having a right cylindrical column formed of two sheets of rigid material positioned diametrically opposite to one another and having radially inwardly extending flanges formed at the adjacent edges thereof, and a pair of rigid lids having circular grooves therein for receiving the upper and lower lips of the last-named column.

5. The stool defined in claim 4, in which the lids are formed of molded plastic material.

6. The stool defined in claim 4, in which the column is formed of a plastic material.

* * * * *